US005207044A

United States Patent [19]

LaSee

[11] Patent Number: 5,207,044

[45] Date of Patent: May 4, 1993

[54] VISION PANEL ASSEMBLY FOR FIRE DOOR PANELS

[76] Inventor: Jack C. LaSee, 308 W. Cedar, Abbotsford, Wis. 54405

[21] Appl. No.: 851,502

[22] Filed: Mar. 16, 1992

[51] Int. Cl.[5] ..... E04B 9/00

[52] U.S. Cl. ..... 52/476; 52/208; 49/171

[58] Field of Search ..... 52/208, 217, 397, 400, 52/476, 767, 768, 769, 770, 824, 825, 455; 49/171

[56] References Cited

U.S. PATENT DOCUMENTS

| | | | |
|---|---|---|---|
| 1,171,443 | 2/1916 | Larson et al. | 52/455 |
| 1,171,444 | 2/1916 | Larson et al. | 52/455 |
| 4,259,818 | 4/1981 | Stark | 52/208 |
| 4,947,606 | 8/1990 | LaSee | 52/455 |

OTHER PUBLICATIONS

Enlarged copies of Larson et al. 117443.
Enlarged copies of Larson et al. 1171444.

*Primary Examiner*—David A. Scherbel
*Assistant Examiner*—C. Kent
*Attorney, Agent, or Firm*—Herman H. Bains

[57] ABSTRACT

A vision panel assembly for a fire door includes a frame structure and a glass vision panel which are mounted in a rectangular opening in the fire door. The frame structure includes a pair of frames which are anchored in grooves in the fire door and which are clamped against the glass vision panel. One frame is provided with fastener bars which are threadedly engaged by fastening screws for securing the frames together. Panel support elements extend through openings in the fastener bars for engaging edges of the glass vision panel to provide support therefor.

8 Claims, 1 Drawing Sheet

VISION PANEL ASSEMBLY FOR FIRE DOOR PANELS

FIELD OF THE INVENTION

This invention relates to fire doors and more particularly to vision panel assemblies for fire doors.

BACKGROUND OF THE INVENTION

This vision panel assembly comprises a component of a commercial fire door and is an improvement of my U.S. Pat. No. 4,947,606 entitled Vision Panel Assembly.

SUMMARY OF THE INVENTION

It is the object of this invention to provide a novel and improved vision panel assembly which is a component of a fire door and which may be readily installed thereon.

The vision panel assembly may be readily packaged in a package of small compass and, when installed, improves the appearance of the fire door.

The vision panel assembly comprising the instant invention includes a pair of rectangular frames which secure and mount the glass vision panel in an opening in the fire door. The frames are disposed in confronting relation and are comprised of frame members of generally C-shaped cross sectional configuration. Each frame member has a pane engaging lip which engages the glass vision panel, and each frame member has a groove engaging lip which is positioned in a groove in one of the surfaces defining the opening in the fire door. One frame is provided with a plurality of fastener bars, each of which is positioned within one of the frame members of one frame. Self-tapping screws clamp the frames together and against the glass vision panel. A plurality of panel supporting elements extend through openings in the fastener bars and engage and support the edges of the glass vision panel.

FIGURES OF THE DRAWING

DESCRIPTION OF THE PREFERRED EMBODIMENT

Figure 1:
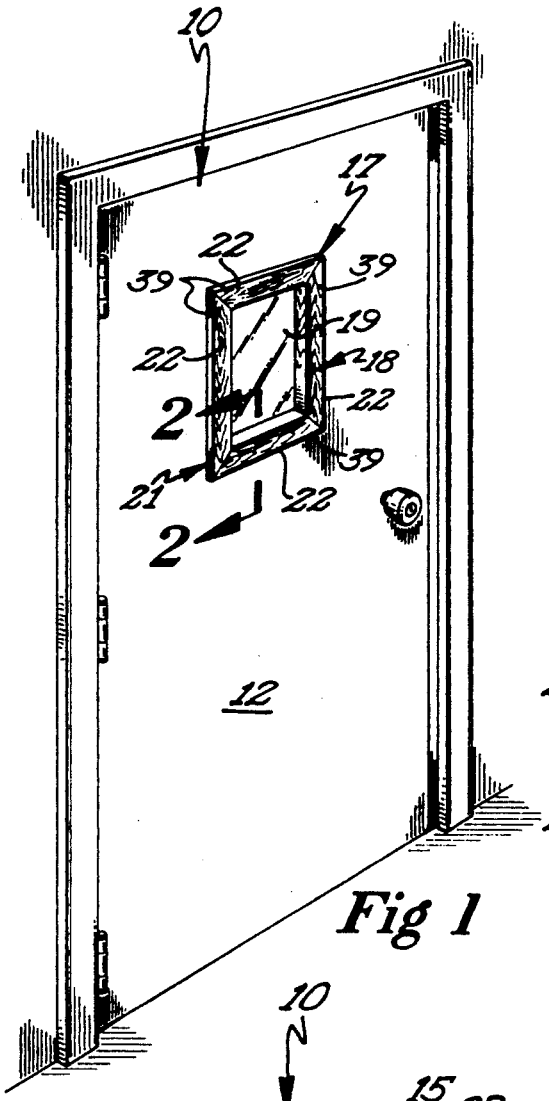
FIG. 1 is a perspective view of a fire door incorporating the novel and improved vision panel assembly.

Referring now to the drawings and more particularly to FIG. 1, it will be noted that a commercial fire door, designated generally by the reference numeral 10, is there shown. The fire door 10 includes a core panel 11 formed of a suitable mineral insulating material. A pair of outer wood panels 12 are secured to opposite surfaces of the core panel 11. The fire door 10 is provided with a rectangular shaped opening 13 which is defined by horizontal planar surfaces 14 and vertical planar surfaces 15. Each of these surfaces has a centrally located longitudinally extending groove 16 therein.

A vision panel assembly 17 is mounted on the opening 13 in the fire door and includes a generally rectangular shaped support frame structure 18 and a rectangular shaped wire glass panel 19. The frame structure 18 includes a pair of similar rectangular frames 20, 21 which are disposed in confronting relation with each other and which are formed of a suitable rigid metallic material. Each frame is comprised of four frame members 22 which are rigidly secured together in right angular relationship.

Figure 2:
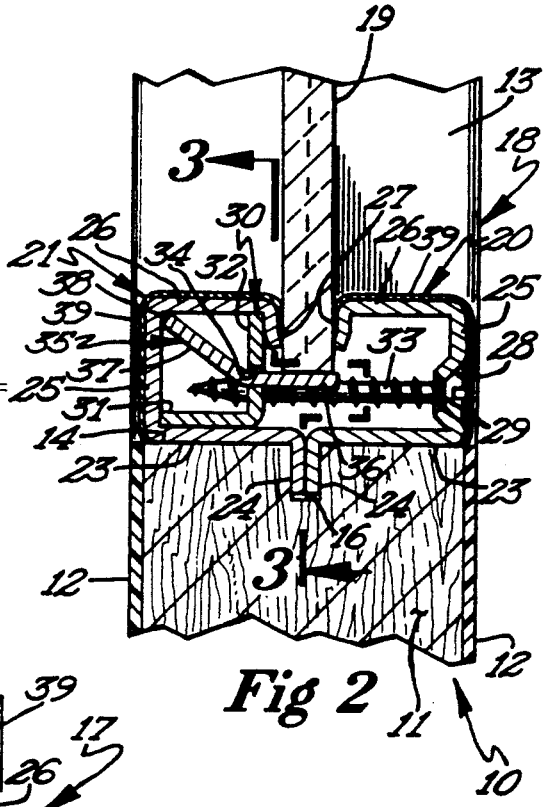
FIG. 2 is a cross sectional view taken approximately along line 2—2 of FIG. 1 and looking in the direction of the arrows.
Figure 3:
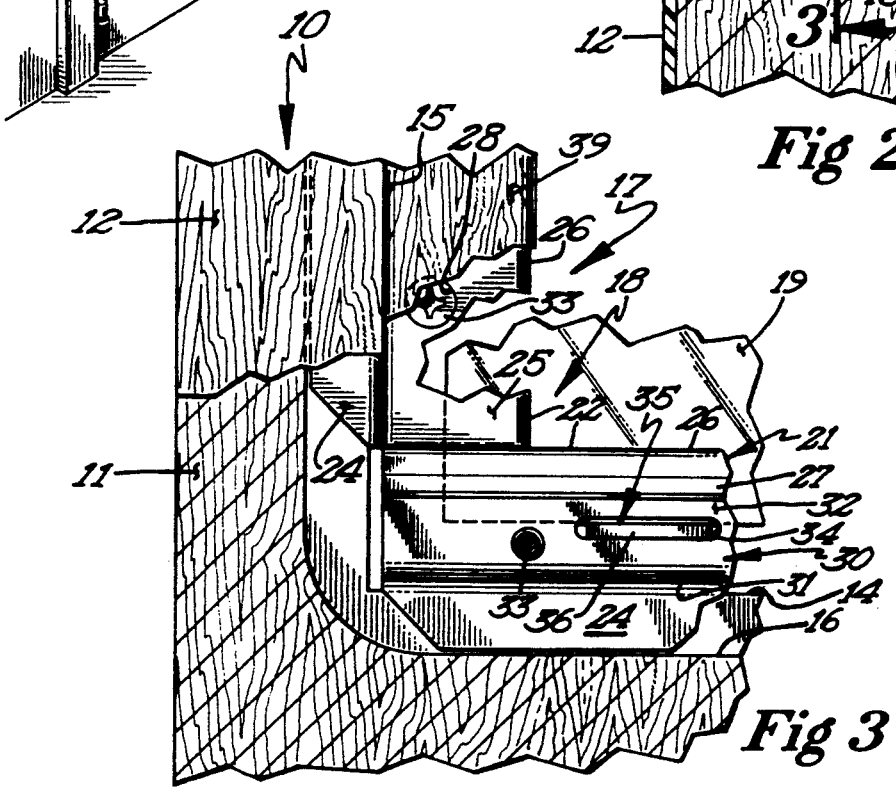
FIG. 3 is a cross sectional view taken approximately along line 3—3 of FIG. 2 and looking in the direction of the arrows.

Each of the frame members 22 is of generally C-shaped cross sectional configuration including a surface engaging frame element 23 having a groove engaging lip 24 integrally formed therewith an extending in substantially right angular relationship therefrom. Each frame member 22 also includes an outer frame element 25 integral with the surface engaging frame element 23 and integral with an inturned frame element 26 which is disposed in substantially parallel relationship with the surface engaging frame element 23. Each inturned frame element 26 has a panel engaging lip 27 integral therewith and extending therefrom in the same direction as the groove engaging lip 24. The panel engaging lip 27 of each frame member 22 engages the rectangular wire vision panel 19, as best seen in FIG. 2.

It will be noted that the outer frame element for each frame member of the rectangular frame 20 has a plurality of longitudinally spaced apart recesses 28 therein, each recess having an opening 29 therethrough. It will also be noted that each of the frame members 22 of the rectangular frame 20 has a plurality of L-shaped fastener bars 30 positioned therein and each fastener bar includes a leg 31 and a leg 32 integral with the leg 31 and extending at right angles thereto. The leg 31 of each fastener bar engages the surface engaging frame element 23 of the frame member 22. The leg 32 of each fastener bar 30 engages the inturned frame element 26 and panel engaging lip 27 of the associated frame member 22. The leg 32 of each fastener bar 30 also has a plurality of longitudinally spaced apart elongate slots 34 therein and a plurality of smaller openings (not shown) for facilitating threaded engagement by fastening screws 33.

The fastening screws 33 extending through the opening 29 of the outer frame elements 25 of the rectangular frame 20 and threadedly engage the legs 32 of the L-shaped fastening bars 30. The fastening screw 33 is self-tapping and when tightened into the fastening bars, clamp the frames 20, 21 against the vision glass panel 19. The groove engaging lips 24 of the frame members 22 will be disposed in the grooves 16 to anchor the frames to the door.

Means are also provided for providing positive support for the glass vision panel 19 and this means includes a plurality of panel support members 35 which are formed of a suitable metallic material and which are of angular shaped configuration. Each panel support member 35 includes a leg 36 which is integral with a leg 37. It will be seen that the included angle between the leg 36 and the leg 37 of each panel support member 35 is greater than 90°.

Each of the panel support members 35 is inserted into one of the slots 34 of a fastener bar 30 so that the leg 36 thereof projects outwardly therefrom. Edge portions of the glass vision panel 19 engage the leg 36 of each panel support member 38 when the vision panel assembly 17 is mounted on a fire door. When the fastening screws 33 are tightened during mounting of vision panel assembly on the fire door, the end edge 38 of the leg 37 of each panel support member 35 will be urged against the juncture portion of a frame member 22 between the outer frame element 25 and inturned frame element 26 thereof. These panel support members 35 provide positive support for the glass vision panel when the vision panel assembly is mounted on the fire door so that the vision panel remains in its fixed clamped position.

The exposed surfaces of the frame members 22 for the rectangular frames 20, 21 have a mitered wood veneer element 39 applied thereto to thereby cover the metal surfaces and present a stainable wood finish. It will be noted that one of the wood veneer elements 39 covers the outer frame element 25 and the inturned frame element 26 of the frame elements 22 for the rectangular frame 20. The outer frame element 25 of each frame member and associated veneer element 39 applied thereto are disposed substantially flush or co-planar with the adjacent outer surface of the fire door. It will also be noted that the veneer elements 39 do not cover or extend over the adjacent surfaces of the fire door. With this arrangement, the heads of the self-tapping fastening screws 33 will be covered with the veneer element. It will be noted that the heads of the fastening screws 33 will be positioned in the recesses 28 of the frame 20. By covering the fastening screw heads, the likelihood of tampering with the vision panel assembly is reduced.

From the foregoing, it will be noted that I have provided a novel and improved vision panel assembly, which is not only of simple and inexpensive construction, but one which functions in a more efficient manner than any heretofore known comparable assembly.

What is claimed is:

1. In combination with a fire resistant door having rectangular shaped opening therein, the opening in the door presenting flat surfaces, each surface having an elongate groove therein, a fire resistant vision panel assembly mounted in said opening and including a pair of similar rectangular frames formed of a metallic material, and a glass vision panel, each frame being comprised of a plurality of frame members rigidly secured together in right angular relation, each frame member being of C-shaped cross sectional configuration and having a panel engaging lip and a groove engaging lip, said groove engaging lip for each frame member being disposed in one of said grooves in one of said surfaces, said panel engaging lip for each frame member engaging said glass vision panel, a plurality of elongate fastener bars each being positioned within one of said frame members of one frame, a plurality of threaded elements engaging the other frame and said fastener bars for clamping the frames together and against said glass vision panel, and a plurality of panel support elements engaging said fastener bars and the frame members of said one frame and supporting said glass vision panel when the frames are clamped together.

2. The combination as defined in claim 1 wherein said fastener bars are of L-shaped configuration including a pair of legs arranged in substantially right angular relation.

3. The combination as defined in claim 1 wherein said panel support elements are of angle shaped configuration.

4. The combination as defined in claim 2 wherein one leg of each fastener bar has a plurality of elongate, longitudinally spaced apart openings therein, each panel support element projecting through an elongate opening in each fastener bar.

5. The combination as defined in claim 1 wherein said groove engaging lip and panel engaging lip for each frame member extend in the same direction.

6. The combination as defined in claim 1 wherein said door has an outer surface and each frame member includes an outer frame element disposed in substantially co-planar or flush relation with the adjacent outer surface of the door.

7. The combination as defined in claim 6 and plurality of veneer elements each being applied to the outer frame element of each frame member overlying and concealing the threaded elements, said veneer elements being stainable to a stain corresponding to the stain or color of the outer surface of the door.

8. The combination as defined in claim 7 wherein said veneer elements cover the vison panel frames to thereby render the vision panel vandal proof and do not cover any surface portion of the door.

* * * * *